US006338656B1

(12) United States Patent
Oliphant et al.

(10) Patent No.: US 6,338,656 B1
(45) Date of Patent: Jan. 15, 2002

(54) MODULAR JACK FOR TYPE III PCMCIA CARDS

(75) Inventors: David Oliphant, Salt Lake City; Ryan A. Kunz, Roy; Thomas A. Johnson, Draper; Steven Lo Forte, Midvale, all of UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/528,331

(22) Filed: Mar. 20, 2000

(51) Int. Cl.[7] ..... H01R 24/00
(52) U.S. Cl. ..... 439/676; 439/923
(58) Field of Search ..... 439/676, 354, 439/344, 946, 923

(56) References Cited

U.S. PATENT DOCUMENTS

| | | | | |
|---|---|---|---|---|
| 2,916,720 | A | 12/1959 | Steans | 339/91 |
| 3,205,471 | A | 9/1965 | Herrmann | 339/176 |
| 4,186,988 | A | 2/1980 | Kobler | 339/176 |
| 4,241,974 | A | 12/1980 | Hardesty | 339/154 |
| 4,303,296 | A | 12/1981 | Spaulding | 339/122 |
| 4,352,492 | A | 10/1982 | Smith | 271/1 |
| 4,407,559 | A | 10/1983 | Meyer | 339/126 |
| 4,428,636 | A | 1/1984 | Kam et al. | 339/97 |
| 4,566,749 | A | 1/1986 | Johnston | 339/95 D |
| 4,602,842 | A | 7/1986 | Free et al. | 339/156 |
| 4,647,136 | A | 3/1987 | Kinoshita et al. | 339/125 R |
| 4,710,136 | A | 12/1987 | Suzuki | 439/374 |
| 4,778,410 | A | 10/1988 | Tanaka | 439/676 |

(List continued on next page.)

FOREIGN PATENT DOCUMENTS

| | | |
|---|---|---|
| JP | 61-256850 | 8/1985 |
| WO | WO95/13633 | 5/1995 |

OTHER PUBLICATIONS

U.S. application No. 09/528,330, Oliphant et al., filed Mar. 20, 2000.

U.S. application No. 09/528,500, Oliphant et al., filed Mar. 20, 2000.

U.S. application No. 09/528,501, Oliphant et al., filed Mar. 20, 2000.

P.E. Knight and D.R. Smith, "Electrical Connector for Flat Flexible Cable," IBM Technical Disclosure Bulletin, vol. 25, No. 1, Jun. 1982.

*Primary Examiner*—Brian Sircus
*Assistant Examiner*—Javaid Nasri
(74) *Attorney, Agent, or Firm*—Workman, Nydegger & Seeley

(57) ABSTRACT

The modular jack allows a RJ series connector plug to be attached to a communications card that conforms to the PCMCIA requirements for a Type III card. The modular jack includes a main body portion including a top surface, a bottom outer surface and a front surface. The receptacle is disposed entirely within the front surface of the modular jack such that no portion of the plug extends through either the top surface or the bottom surface of the main body portion of the modular jack. Thus, the modular jack allows the communications card to be connected to standard RJ series plugs without deviating from the Type III PCMCIA card height requirement, even when the plug is inserted into the jack. Desirably, the main body portion has a height measured from the top surface to the bottom surface that is generally equal to or less than about 10.5 mm. Additionally, the receptacle preferably includes an upper inner surface and a lower inner surface that are separated by a distance that is generally equal to or less than about 10.1 mm. The modular jack may also include a latching area that securely holds the connector plug within the receptacle, but allows the connector plug to be removed from the receptacle without the user depressing a biased clip of the connector plug if a predetermined force is applied to a body of the connector plug.

33 Claims, 10 Drawing Sheets

U.S. PATENT DOCUMENTS 4,875,872 A 10/1989 Tanaka ..... 439/344
4,915,648 A 4/1990 Takase et al. ..... 439/490
5,035,641 A 7/1991 Van-Santbrink et al. .... 439/329
5,051,099 A 9/1991 Pickles et al. ..... 439/108
5,139,439 A 8/1992 Shie ..... 439/359
5,183,404 A 2/1993 Aldous et al. ..... 439/55
5,184,282 A 2/1993 Kaneda et al. ..... 361/395
5,310,360 A 5/1994 Peterson ..... 439/571
5,336,099 A 8/1994 Aldous et al. ..... 439/131
5,338,210 A 8/1994 Bechman et al. ..... 439/131
5,364,294 A 11/1994 Hatch et al. ..... 439/676
5,391,083 A 2/1995 Roebuck et al. ..... 439/76
5,391,094 A 2/1995 Kakinoki et al. ..... 439/638
5,411,405 A 5/1995 McDaniels et al. ..... 439/131
5,425,660 A 6/1995 Weikle ..... 439/676
5,457,601 A 10/1995 Georgopulos et al. ..... 361/686
5,478,261 A 12/1995 Bogese, II ..... 439/676
5,481,616 A 1/1996 Freadman ..... 381/90
5,499,923 A 3/1996 Archibald et al. ..... 439/26
5,505,633 A 4/1996 Broadbent ..... 439/329
5,509,811 A 4/1996 Homic ..... 439/55
5,538,442 A 7/1996 Okada ..... 439/676
5,547,401 A 8/1996 Aldous et al. ..... 439/676
5,561,727 A 10/1996 Akita et al. ..... 385/88
5,562,504 A 10/1996 Moshayedi ..... 439/638
5,580,274 A 12/1996 Tsair ..... 439/571
5,608,607 A 3/1997 Dittmer ..... 361/686
5,634,802 A 6/1997 Kerklaan ..... 439/131
5,660,568 A 8/1997 Moshayedi ..... 439/654
5,679,013 A 10/1997 Matsunaga et al. ..... 439/144
5,697,815 A 12/1997 Drewnicki ..... 439/638
5,727,972 A 3/1998 Aldous et al. ..... 439/655
5,773,332 A 6/1998 Glad ..... 439/344
5,797,771 A 8/1998 Garside ..... 439/610
5,816,832 A 10/1998 Aldous et al. ..... 439/131
5,876,218 A 3/1999 Liebenow et al. ..... 439/74
5,938,480 A 8/1999 Aldous et al. ..... 439/676
5,980,322 A 11/1999 Madsen et al. ..... 439/621
5,984,731 A 11/1999 Laity ..... 439/676
5,989,042 A 11/1999 Johnson et al. ..... 439/131
6,005,774 A 12/1999 Chiba et al. ..... 361/737
6,033,240 A 3/2000 Goff ..... 439/131
6,116,962 A 9/2000 Laity ..... 439/676

MODULAR JACK FOR TYPE III PCMCIA CARDS

BACKGROUND OF THE INVENTION

1. Field of the Invention

The present invention generally relates to connectors used with electronic devices such as computers. More specifically, the present invention relates to connectors used with communications cards that allow computers to be connected to electronic devices and communications systems.

2. Description of Related Art

Portable computers and other electronic equipment frequently use communications cards to allow electrical communication to be established between electronic devices or to allow electronic devices to be connected to communication systems. The communications cards are typically located internally within the computer or electronic equipment and the cards are relatively small in size. These communications cards, for example, are commonly used with modems, fax/modems, Local Area Network (LAN) adaptors and cellular telephone equipment.

Conventional communications cards are often constructed according to the Personal Computer Memory Card International Association (PCMCIA) guidelines, which set forth the physical specifications and electronic architecture of the cards (also known as PC cards). The PCMCIA guidelines define three types of cards and sockets for support of electronic equipment. For instance, PCMCIA standards require all PC cards to have the same length and width (roughly the size of a credit card), and each card includes a connector to allow it to be connected to the computer or other host device. In particular, according to the known PCMCIA standards, PC cards have a length of 85.6 mm (3.4 inches), a width of 54.0 mm (2.1 inches), and a height of 3.3 mm (0.1 inches), 5.0 mm (0.2 inches) or 10.5 mm (0.4 inches) depending upon if the card is a Type I card, Type II card or Type III card, respectively. Type I PC cards are typically used for memory devices such as read only memory (RAM), flash memory or static random access memory (SRAM). Type II PC cards are generally used with input/output (I/O) devices such as data/fax modems, LANs and mass storage devices. Type III PC cards are used for devices whose components are thicker and require additional space. The PCMCIA guidelines also define corresponding types of sockets. Type I sockets support only Type I cards, Type II sockets support Type I and II cards, and Type III sockets support all three types of cards.

A conventional PC card 10 is shown in FIG. 1. The PC card 10 has a generally rectangular shaped body with a top surface 12, a bottom surface 14, a right side 16, a left side 18, a front end 20 and a rear end 22. The terms "front" and "rear" are used in reference to the direction in which the PC card 10 is inserted into the receiving socket. The front end 20 of the PC card 10 includes a 68-pin connector 24 that is used to connect the card to an electronic device such as a notebook or lap top computer. Disposed within the PC card 10 is a printed circuit board or substrate 26 with various electronic components 28 that provide the necessary circuitry to perform the intended functions of the PC card.

Additionally, a variety of connectors have been developed in order to facilitate electrical communication between electronic devices and to allow electronic devices to be connected to communication systems. Conventional connectors typically include a plug and a corresponding jack that is sized and shaped to receive the plug. Thus, when the plug is inserted into the jack, the connector allows electrical communication to be established between the plug and the jack.

Conventional connectors are frequently constructed according to standards that are well known in the art to promote compatibility and interchangeability. These standard connectors allow various electronic devices and communication systems to be interconnected or linked as desired by the user. A conventional connector that is well known in the art is the RJ-xx series of connectors, such as the RJ-11, RJ-12 and RJ-45 connectors. The RJ series of connectors include a plug and a corresponding jack that is sized and configured to receive the plug. The RJ-11 connector, for example, includes four or six contact pins and is commonly used to attach communication devices, such as telephones, facsimile machines and modems, to electronic devices. The RJ-45 connector includes eight contact pins and it is frequently used to connect LANs or Ethernets to electronic devices. The RJ series of connectors have the same overall configuration except for slightly different widths. Thus, the RJ-11 and RJ-45 connectors have the same general configuration, but the RJ-45 connector is slightly wider than the RJ-11 connector.

As shown in FIGS. 2 and 3, a conventional RJ series connector 30, such as a RJ-11 connector, includes a jack 32 and a plug 34. The plug 34 includes a rectangular contact pin block 36 with a front end 38, a rear end 40, a top surface 42, a bottom surface 44 and a plurality of contacts 46 located proximate the front end of the block. The contacts 46 are recessed within tracks formed in the contact pin block 36, and the contacts are accessible from the front end 38 and bottom surface 44 of the block. A cable 48 is used to electrically connect the plug 34 to a communications system or other electronic device. The front end 38 of the contact pin block 36 typically includes a pair of notches that define front abutment surfaces 50 that are perpendicular to the top surface 42 of the block.

A biased retention clip 52 extends from the top surface 42 of the contact pin block 36. The biased clip 52 includes a broad base 54 in which the front end is integrally attached to the top surface 42 or front end 38 of the block 36, and the other end includes a narrow tab 56 extending away from the base 54. An abrupt transition between the base 54 and the tab 56 creates a pair of retention edges 58 on both sides of the tab 56. The biased clip 52 extends at an angle relative to the top surface 42 of the contact pin block 36 and the biased clip may be elastically deformed towards the top surface of the contact pin block to allow the plug 34 to be inserted and removed from the jack 32.

As best seen in FIG. 2, the jack 32 includes an aperture 60 that is sized and configured to receive the plug 34. The aperture 60 includes a first pair of notches 62 with a first opening 63 disposed between this first pair of notches, and a second pair of notches 64 with a second opening 65 disposed between this second pair of notches. When it is desired to insert the plug 34 into the jack 32, the user depresses the biased clip 52 towards the top surface 42 of the contact pin block 36 and this permits the plug to be inserted into the receptacle. After the plug 34 is inserted into the jack 32, the user releases the biased clip 52 and, as shown in FIG. 3, the biased clip returns to its original position. The plug 34 is securely held within the jack 32 because the retention edges 58 of the biased clip 52 engage the inner surfaces of the second pair of notches 64 and the narrow tab 56 extends through the opening 65 formed between the second pair of notches.

Alternatively, instead of the user depressing the biased clip 52 towards the top surface 42 of the contact pin block 36, the user can simply insert the plug 34 into the aperture 60 and the base 54 of the biased clip 52 will engage the lower surfaces of the second pair of notches 64. This engagement of the base 54 with the lower surfaces of the second pair of notches 64 forces the biased clip 52 downwardly towards the upper surface 42 of the contact pin block 36, and this allows the plug 34 to be inserted into the jack 32. In either case, the plug 34 is securely held within the jack 32 and it cannot be removed by simply pulling on the plug or cable 48 in a direction away from the receptacle. Instead, the biased clip 52 must be depressed towards the upper surface 42 of the contact pin block 36 in order to remove the plug 34 from the receptacle 60.

If excessive force to remove the plug 34 from the jack 32 is applied to either the plug or the cable 48 without depressing the biased clip 52, the biased clip will break. That is, because the biased clip 52 extends through the opening 65 and the retention edges 58 securely engage the inner surface of the second pair of notches 64, the plug 34 cannot be removed from the receptacle without depressing the biased clip. Thus, the biased clip 52 will break and the plug 34 will fail if too much force is applied to the cable 48 or plug 34 without depressing the biased clip 52. Accordingly, if the cable 48 is accidentally stepped on or tripped over, or the computer is suddenly moved, for example, this may break the biased clip 52. Disadvantageously, if the biased clip 52 is broken, the plug 34 must be replaced. Replacement of the plug 34 is frequently time consuming, inconvenient and awkward. Further, the user may be unable to use the communications or electronic device while the plug 34 is broken.

As shown in FIGS. 2 and 3, the jack 32 includes a plurality of contact pins 66 that elastically deform or deflect as the plug 34 is inserted into the aperture 60. In greater detail, each contact pin 66 includes a wire with a straight section 68 and a contact section 70 that are joined by a bend 72. As shown in phantom in FIG. 3, the wire is bent at an angle $\alpha$ of at least 120° with respect to the straight section 68 when the plug 34 is not inserted into the jack 32. When the plug 34 is inserted into the jack 32, the contact 46 on the plug 34 pushes the contact section 70 of the pin 66 downwardly towards the straight section 68 until the contact pin is bent or folded back upon itself at an angle of about 180°. Disadvantageously, bending the contact pin 66 at this severe angle creates significant stresses in the contact pin proximate the bend 72, which may lead to failure of the pin.

The electronic devices used with these conventional RJ series connectors are becoming smaller and smaller. Because these electronic devices are becoming smaller, one or more of the dimensions of the RJ series connector may now be larger than one or more of the dimensions of the electronic device. For example, communications cards that comply with PCMCIA guidelines have a height that is less than the height of conventional RJ series connectors. In particular, communications cards that comply with PCMCIA standards have a height of 10.5 mm for a Type III PC card, but conventional RJ-11 jacks have a minimum height of at least 12.0 mm. Thus, a conventional RJ-11 jack cannot be mounted in a PC card because the height of the RJ-11 jack exceeds the height limitation of the PC card.

As shown in FIG. 4, a known device to connect a RJ series connector to a PC card includes a physical/electrical connector 80 that is attached to the rear end of a PC card 82. The physical/electrical connector 80 includes a generally rectangular shaped body 84 with a conventional RJ series jack or receptacle 86. Disadvantageously, because the physical/electrical connector 80 extends outwardly from the computer 88, the computer may no longer fit within its carrying case, the protruding connector may be easily broken or damaged, the protruding connector may limit the potential uses of the computer, and the connector alters the aesthetics of the computer.

It is also known to use flexible connectors or adaptors to connect RJ series connectors to a communications card. These known adaptors, however, suffer from several drawbacks such as requiring the user to externally carry the adapter from the computer. Thus, the user must remember to bring the adaptor, otherwise the communications card cannot be used. Disadvantageously, users commonly misplace or lose such adaptors. In addition, these known adaptors are typically bulky and that exacerbates the problems associated with externally carrying the adaptor. In addition, these known adaptors typically extend well beyond the periphery of the host computer and that limits the usefulness of the adaptor, and often poses problems when used in tight space confinements.

Other known devices have been developed in order to allow conventional RJ series connectors to be used with PC cards. For example, U.S. Pat. Nos. 5,183,404; 5,335,099; 5,338,210; 5,547,401; 5,727,972 and 5,816,832 disclose assorted devices and methods to connect RJ series connectors to PC cards and other electronic devices. These patents are assigned to the same assignee as the present application and are hereby incorporated by reference in their entireties. Briefly, the above-listed patents generally disclose a thin plate that is slidably mounted to a PC card. The thin plate includes a top surface with an aperture formed therein and a plurality of contact wires mounted to the thin plate. Each contact wire includes a first end that is freely exposed within the aperture and a second end that is connected to the thin plate. A flexible wire ribbon is typically used to electrically connect the second end of the contact wires to contacts on a printed circuit board located within the PC card.

As known in the art, the thin plate selectively slides between an extended position and a retracted position. In the extended position, the aperture is exposed such that a corresponding plug, such as a RJ-11 plug, can be inserted and the contacts on the plug engage the contact wires extending into the aperture. This allows electrical connection to be established between the plug and the printed circuit board. In particular, electrical communication is established between the plug, contact wires, flexible wire ribbon and printed circuit board. When not in use, the thin plate is retracted into the PC card and the aperture is not exposed. The flexible wire ribbon allows the thin plate to be repeatedly moved between the extended and retracted positions because it freely bends or folds as the plate is moved.

Another known device for using a RJ series connector with a PC card is disclosed in U.S. Pat. No. 5,773,332 issued to Glad. As shown in FIG. 5, the Glad patent discloses a communications card 90 that follows the PCMCIA card Type III standards for dimensions and configuration. The Type III PC card 90 includes two receptacles 92, 94 that are designed to receive standard RJ-xx plugs (specifically, a RJ-11 plug and a RJ-45 plug). The Type III PC card 90 also includes an upper surface 96 and a lower surface 98 that form a portion of the housing of the communications card. The Glad patent explains that because the height of a PCMCIA Type III card is still not great enough to allow standard RJ-xx series receptacles to be mounted therein, T-shaped cutouts 100 are removed from the housing of the communications card 40. The T-shaped cutouts 100 accommodate the biased clip 102 and the ridge 104 present on the connector plug 106. The shape of the T-shaped cutout 100 engages the biased clip 102 and the ridge 104 to hold the plug 106 in place. The Type III PC card height limitation of 10.5 mm, however, is not satisfied when the connector plug is inserted into the receptacles because the biased clip 102 extends through the cutout 100 and protrudes through the upper surface 96 of the housing. Disadvantageously, the biased clip 102 can be easily broken or damaged because it protrudes through the upper surface 96 of the card 90. Additionally, the protruding clip 102 may limit design options and uses of the communications card because it does not satisfy the Type III PC card configuration and size requirements. Further, the PC card 90 may not be used in close fitting Type III sockets because the socket may prevent the biased clip 102 from extending through the cutout 100. Thus, the connector plug 106 will not be secured to the PC card 90.

Still another known device for connecting a RJ series connector to a PC card is disclosed in U.S. Pat. No. 5,984,731 issued to Laity. As shown in FIGS. 6 and 7, a plug 110 is inserted into a receptacle 112 located between upper and lower surfaces 114, 116 of a communications card 118. The receptacle 112 includes a cutout 120 to allow the biased clip 122 of the plug 110 to extend through an outer surface of the communications card 118.

Specifically, by providing an open bottom (or cutout) in the receptacle, the retention clip, in the fully inserted position of the modular plug, is permitted to project outwardly from the lower, horizontal outer surface of the card. Accordingly, the 10.5 mm height of the Type III card can incorporate a receptacle conforming to the FCC RJ connector standards, if there are cutouts in the lower outer surface of the card.

The Laity patent discloses a complicated structure with a plurality of components that is used to physically and electrically connect the plug 110 to the communications card 118. For example, disposed between the upper and lower surfaces 114, 116 of the communications card 118 are contact wires 124 that include a first end 126 soldered to the upper surface of the printed circuit board 128 and a second end 130 that extends into the receptacle 112. As seen in FIG. 6, the contact wires 124 include a first angled section 132 that is bent at a 180° angle such that the wire is folded back upon itself and a second angled section 134 that is bent at a 90° angle.

In greater detail, the housing of the communications card 118 defines the receptacles 112, and the receptacles are sized and configured to closely receive standard RJ-type modular plugs. A contact block with planar abutment surfaces is engaged by and bonded to the upper surface of the rear margin of the printed circuit board 128. Vertical slots in the wall of the contact block are longitudinally aligned with grooves in the interior surface of the top wall of the receptacle body. The first ends or solder tails 126 of the contact wires 124, which are soldered to the printed circuit board 128, are contained within the longitudinal confines of recesses. After fabrication of the subassembly comprising the contact block and the printed circuit board, these recesses facilitate inspection of the integrity of the solder joints connecting the first ends 126 of the contact wires 124 to the printed circuit board 128 and provide sufficient space to permit resoldering if necessary. Disadvantageously, if the receptacles in the housing are not exactly aligned with the contact block, the slots in the wall of the contact block and the grooves in the inner surface of the receptacle will not be aligned. This undesirably causes the pins to be laterally deformed and may result in the failure of the connector. Additionally, hand soldering of the contact wires 124 to the printed circuit board 128 is time consuming, expensive and unreliable. Further, because the contact block is permanently attached to the substrate, this forces the user to dispose of the entire communications card if the connector is broken or damaged. Finally, the biased clip of the plug is more likely to be broken or damaged because it protrudes through an outer surface of the communications card, and the protruding clip may limit the usefulness of the card.

SUMMARY OF THE INVENTION

A need therefore exists for a modular jack for a Type III PC card in which the connector plug is contained within a receptacle and the connector plug does not protrude through either the top or bottom surfaces of the PC card.

The modular jack of the present invention advantageously allows communications cards to be connected to standard RJ series plugs without deviating from the Type III PC card size and configuration requirements, even if the plug is inserted into the jack. The modular jack also allows communications cards to be interconnected with various electronic devices and communications systems because it is configured to receive standard RJ series plugs. The modular jack also allows communications cards to be quickly, easily and securely connected and disconnected to desired electronic devices and communications systems. This permits the communications cards to be readily used with portable systems or while traveling. Further, the modular jack requires no changes or modifications to the standard RJ series plugs.

One aspect of the present invention is a modular jack that is mounted to a Type III PC card. Significantly, when the plug is received within the jack, no portion of the plug or modular jack violates the Type III PC card height limitation of 10.5 mm.

Another aspect is a modular jack with a receptacle in the front surface of a modular jack. When the plug is inserted into the receptacle, the plug is contained within a receptacle and no portion of the plug, including the biased clip, extends through another surface of the modular jack. Significantly, because no portion of the plug protrudes through the upper or lower surfaces of the modular jack when the plug is inserted into the jack, the modular jack and the received plug satisfy the 10.5 mm height limitation of a Type III PC card. Advantageously, because no portion of the biased clip protrudes through the upper or lower surfaces of the modular jack, the clip is less likely to be broken or damaged.

Still another aspect is a modular jack that includes a latching area that allows the plug to be removed from the receptacle without depressing the biased clip if sufficient force is applied to the plug. Thus, if sufficient force is applied to the plug or the cable attached to the plug, the latching area allows the plug to be released from the receptacle without breaking the biased clip or pulling the cable out of the plug. Advantageously, if a large force is accidentally applied to the plug or cable, such as the user stepping on the cable or the computer being unexpectedly moved, the latching area allows the plug to be released from the receptacle without damaging the plug or receptacle.

Yet another aspect is a modular jack with one or more receptacles that allow a RJ series plug to be simply and easily connected and disconnected from a Type III PC card without the use of any adaptors, connectors, or any moving parts. Advantageously, the modular jack is relatively inexpensive to construct and assemble because the connector does not contain any complicated structures or movable parts.

Another aspect is a modular jack with a receptacle that is sized and configured to securely hold a RJ series plug within the receptacle while the biased clip is positioned in a partially compressed configuration. Advantageously, because the biased clip remains partially compressed, the biased clip continually pushes the front and lower surfaces of the plug into the receptacle and that causes the contacts in the receptacle to positively engage the corresponding contacts in the plug. This results in improved electrical communication between the plug and the modular jack.

Yet another aspect of the present invention is a modular jack that can be directly attached to a desired electronic device such as a computer. Advantageously, when the plug is received within the modular jack, no portion of the plug or modular has a height that is greater that about 10.5 mm.

Still another aspect of the present invention is a modular jack with a receptacle that is sized and configured to hold a RJ series plug while maintaining an overall modular jack height that is generally equal to or less than 10.5 mm. Significantly, as computers are driven to thinner and thinner profiles, the modular jack can be mounted to a side of the computer.

Further aspects, features and advantages of the present invention will become apparent from the detailed description of the preferred embodiments that follows.

BRIEF DESCRIPTION OF THE DRAWINGS

The appended drawings contain figures of preferred embodiments of the modular jack for Type III PCMCIA cards. The above-mentioned features of the modular jack, as well as other features, will be described in connection with the preferred embodiments. However, the illustrated embodiments are only intended to illustrate the invention and not limit the invention. The drawings contain the following figures.

DETAILED DESCRIPTION OF PREFERRED EMBODIMENTS

The present invention involves a modular jack for a Type III PCMCIA card. The principles of the present invention, however, are not limited to modular jacks for Type III PCMCIA cards. It will be understood that, in light of the present disclosure, the modular jack disclosed herein can be successfully used in connection with other types of electrical equipment, devices and communications systems.

Additionally, to assist in the description of the modular jack and communications card, words such as top, bottom, front, rear, right and left are used to describe the accompanying figures. It will be appreciated, however, that the present invention can be located in a variety of desired positions—including various angles, sideways and even upside down. A detailed description of the modular jack for a Type III PCMCIA card now follows.

Figure 1:
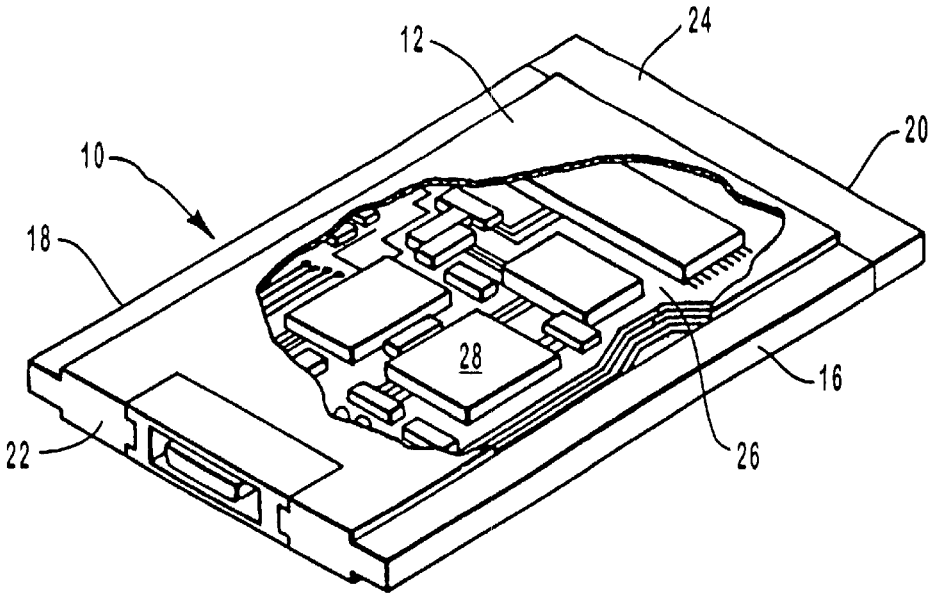
FIG. 1 (PRIOR ART)
FIG. 1 is a perspective view of a conventional communications card constructed in accordance with PCMCIA standards.
Figure 2:
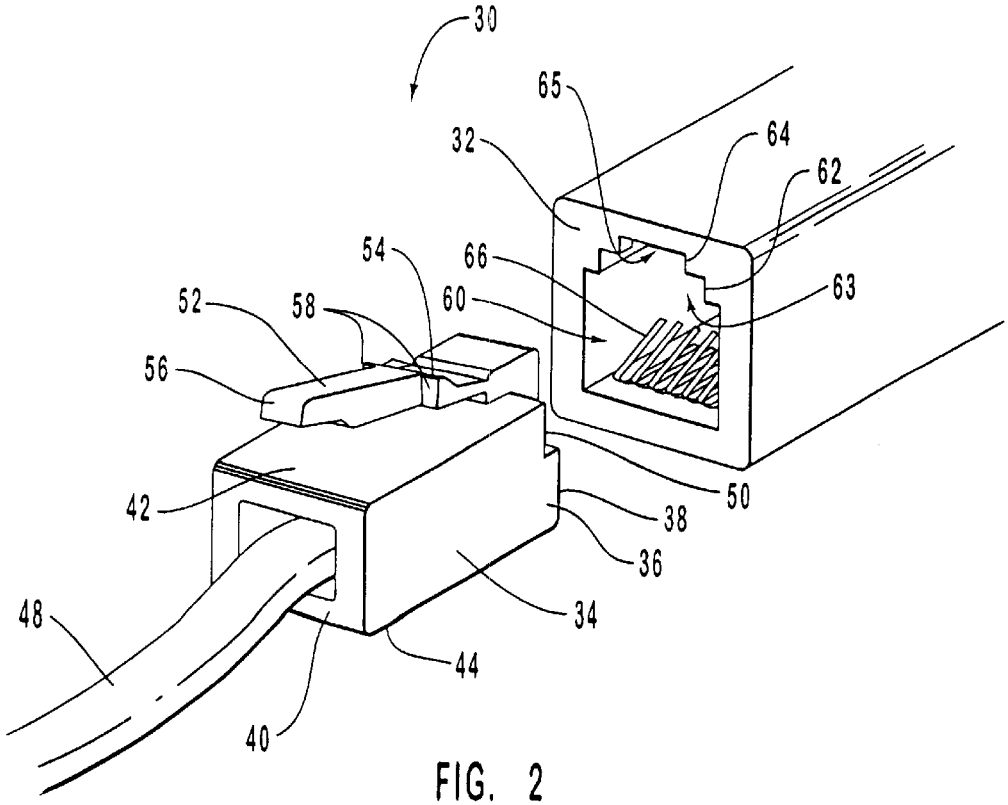
FIG. 2 (PRIOR ART)
FIG. 2 is a perspective view of a conventional RJ series connector, illustrating a plug and a corresponding receptacle.
Figure 3:
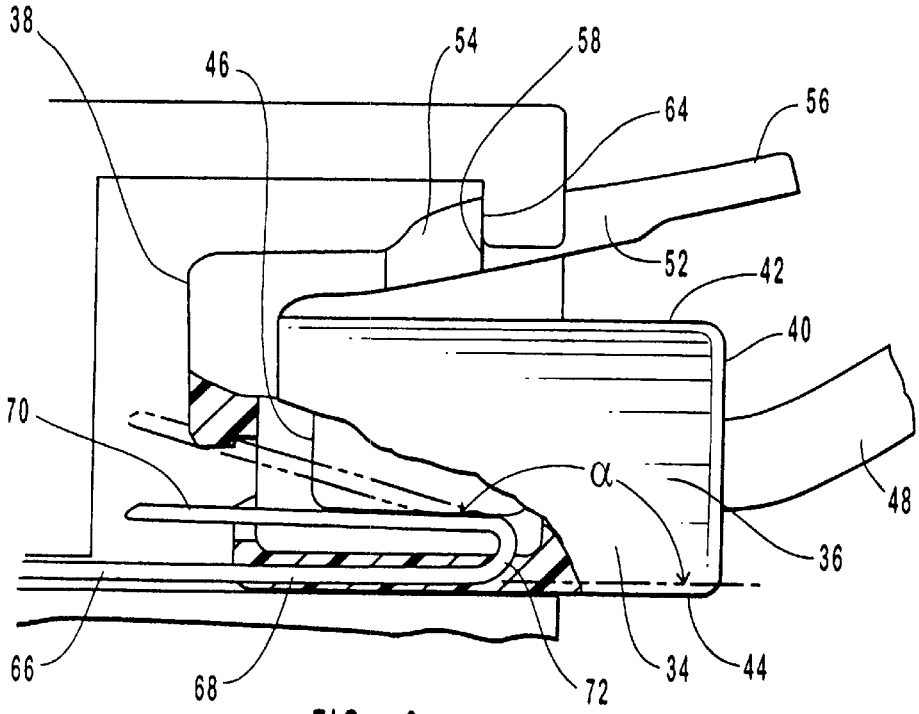
FIG. 3 (PRIOR ART)
FIG. 3 is a side view of the conventional RJ series connector shown in FIG. 2, with a portion of the plug and receptacle cut away, illustrating the plug inserted into the receptacle.
Figure 4:
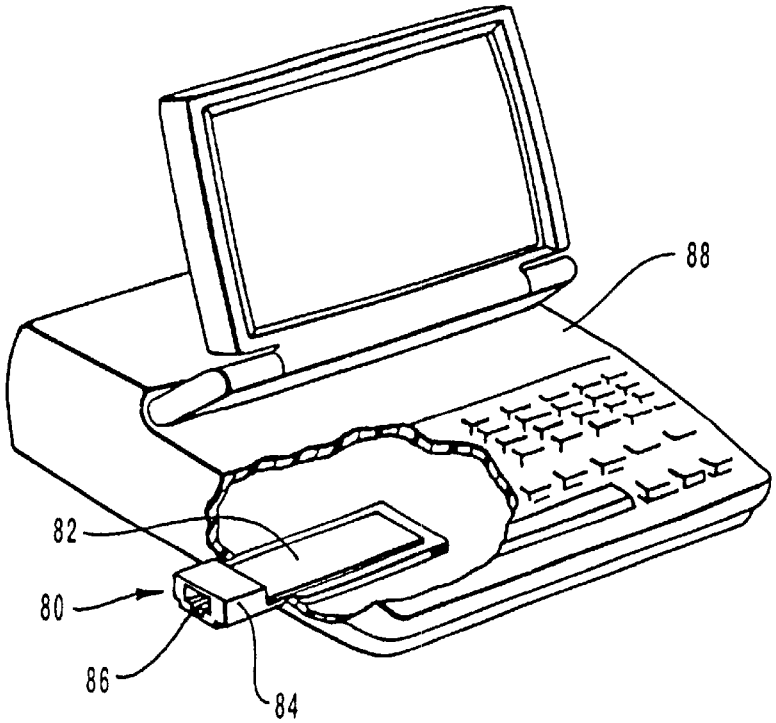
FIG. 4 (PRIOR ART)
FIG. 4 is a perspective view of a conventional communications card with an integrally attached RJ series receptacle, illustrating the communications card inserted into a computer, with a portion of the computer cut away.
Figure 5:
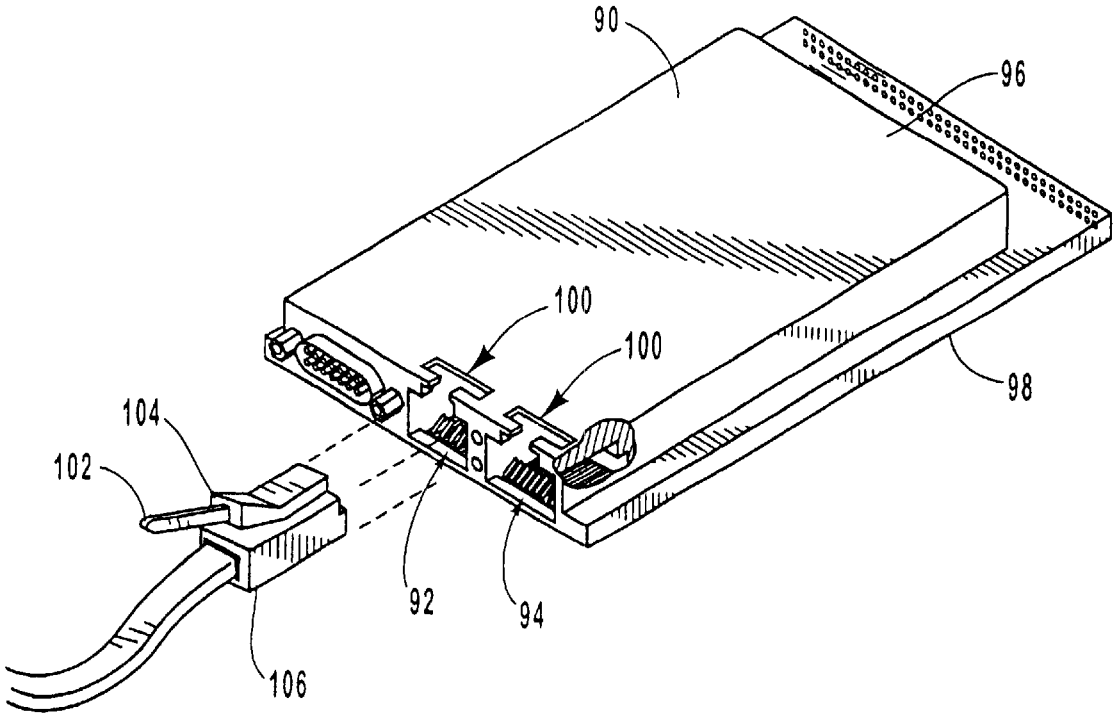
FIG. 5 (PRIOR ART)
FIG. 5 is a perspective view of a conventional connector for a communications card, illustrating a RJ series plug and cutouts along an upper surface of the communications card.
Figure 6:
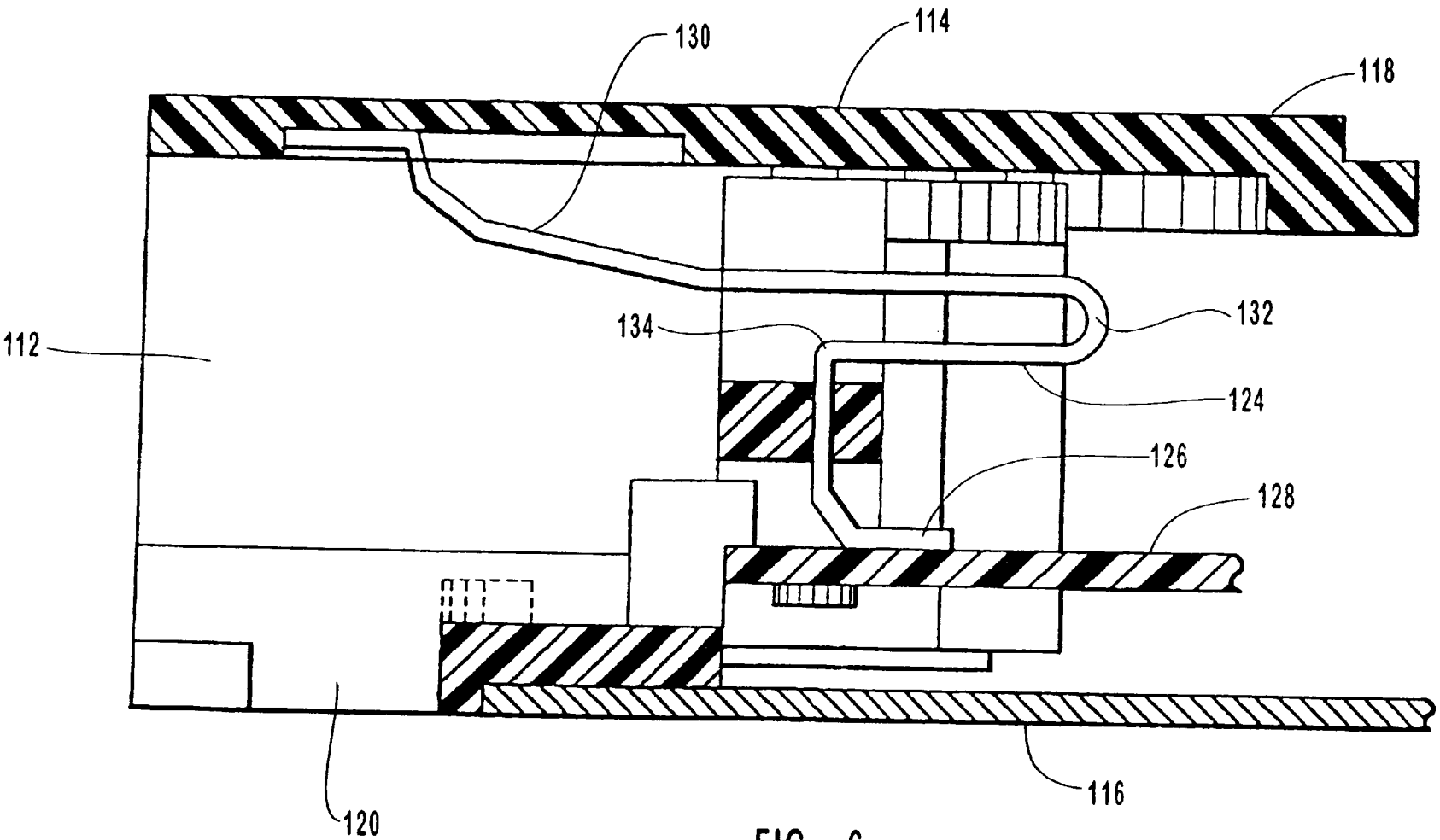
FIG. 6 (PRIOR ART)
FIG. 6 is a cross-sectional side view of a conventional connector for a communications card, with a portion of the communications card cut away, illustrating a receptacle located in the rear portion of the communications card.
Figure 7:
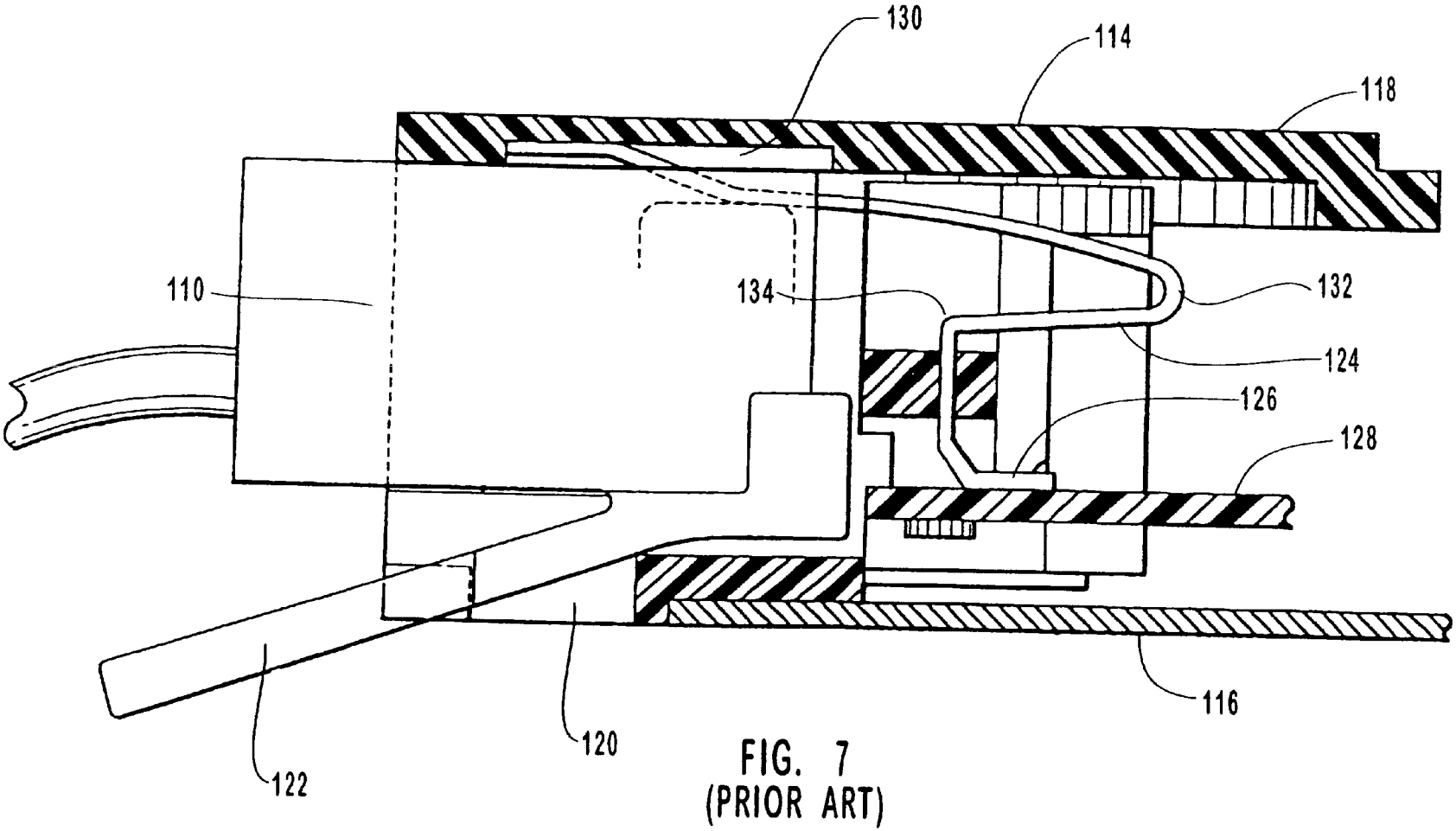
FIG. 7 (PRIOR ART)
FIG. 7 is a cross-sectional side view of the conventional connector shown in FIG. 6, illustrating a plug inserted into the receptacle.
Figure 8:
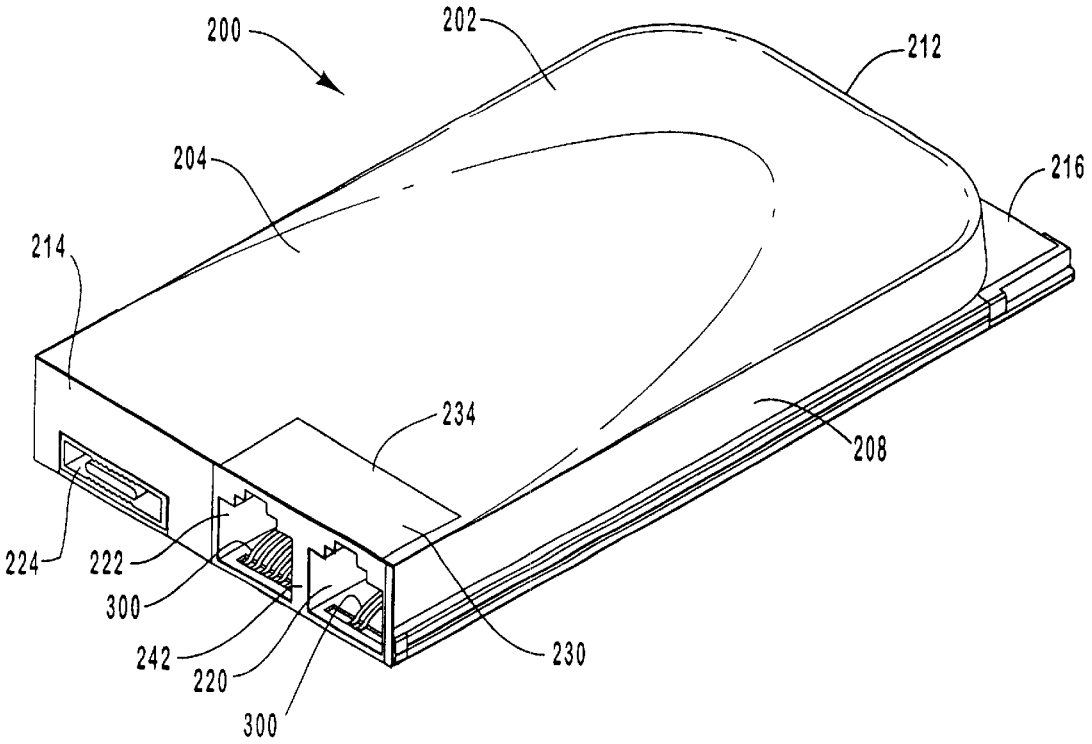
FIG. 8 is a perspective view of a communications card in accordance with a preferred embodiment of the present invention.
Figure 9:
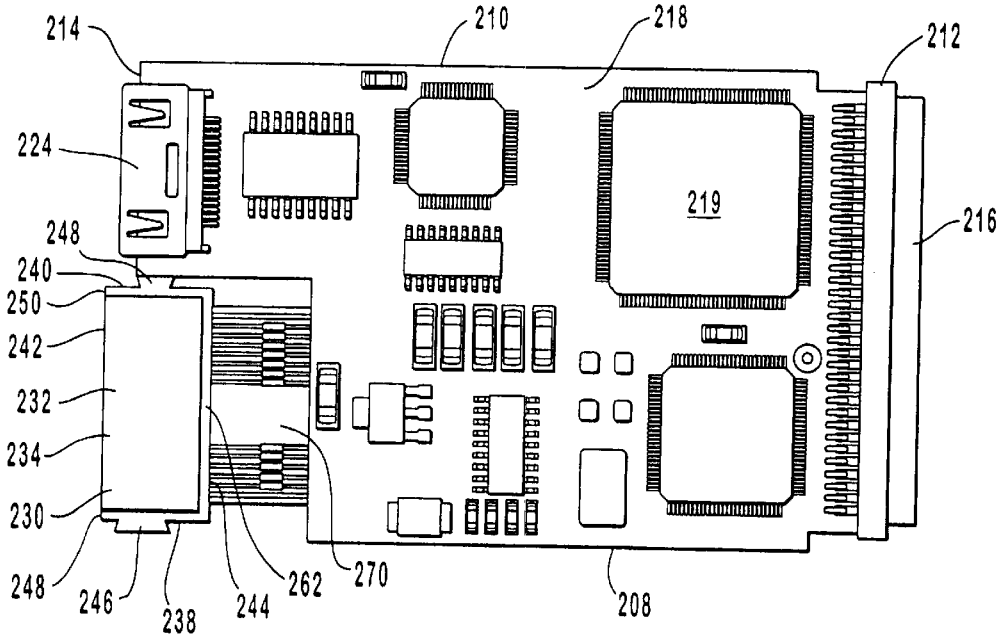
FIG. 9 is a top view of the communications card shown in FIG. 8, with the housing of the main body portion of the communications card removed.

As seen in FIGS. 8 and 9, a communications device in accordance with a preferred embodiment of the present invention includes a communications card 200 that is configured to be inserted into a corresponding socket of a host device such as a computer (not shown). The computer can be any type of a wide variety of computers includes personal, portable, laptop, notebook, palm, personal data assistants (PDAs), etc. The communications card 200 includes a housing 202 with a generally rectangular shaped configuration having a top surface 204, bottom surface 206, right side 208, left side 210, front end 212 and rear end 214. The communications card 200 conforms to the Type III PCMCIA standards with a length of 85.6 mm (3.4 inches), a width of 54.0 mm (2.1 inches), and a height of 10.5 mm (0.4 inches), but it will be appreciated that the card may have other desired sizes and configurations that are suitable for its intended purpose, and the card does not have to conform to any specific standards or guidelines. A 68-pin connector 216 is located at the front end 212 of the card 200 to allow the card to communicate with the computer, but other suitable connectors such as serial, parallel, SCSI, or other types of ports, may also be used. A printed circuit board (PCB) or substrate 218 is located within the housing 202 and it includes logic circuitry and various components 219 that are used to perform the desired functions of the communications card 200.

Located at the rear end 214 of the card 200 are two receptacles 220 and 222 that are sized and configured to receive conventional RJ series plugs. Preferably, the receptacle 220 is sized and configured to receive a RJ-11 connector plug and the receptacle 222 is sized and configured to receive a RJ-45 connector plug, but it will be appreciated that the receptacles can be sized and configured to receive any desired RJ series plug or any other suitable type of plug. Alternatively, the same receptacle may be sized and configured to receive different types of connector plugs such as a RJ-11 connector plug and a RJ-45 connector, for example. These receptacles 220 and 222 may be illuminated as described in assignee's copending U.S. patent application Ser. No. 09/528,330 filed Mar. 20, 2000, entitled Illuminated Electrical Jack System, which is hereby incorporated by reference it its entirety.

The rear portion of the card 200 preferably includes a Sub-D connector 224 for connection to a cellular telephone or other suitable electronic equipment, but other types of connectors such as a pin, BNC or DIN connectors may also be connected to the communications card. Additionally, another modular jack 230 or additional receptacles of suitable sizes and configurations may also be attached to the rear portion of the communications card 200.

The receptacles 220 and 222 are located in a modular jack 230 that includes a main body portion 232 having a generally rectangular configuration with an upper surface 234, a lower surface 236, a right side 238, a left side 240, a front surface 242 and a rear surface 244. As shown in FIG. 8, the upper surface 234 of the modular jack 230 is generally aligned and substantially planar with the top surface 204 of the housing 202 of the communications card 200. Alternatively, the top surface 204 of the housing 202 may be configured to cover the upper surface 234 of the modular jack 230. The bottom surface 206 of the housing 202 preferably encloses the lower surface 236 of the modular jack 230 and is generally aligned with a lip located proximate the front surface 242 of the modular jack. On the other hand, the lower surface 236 of the modular jack 230 may be generally aligned with the bottom surface 206 of the communications card 200. In any of these configurations, however, the height of the modular jack 230 is the generally equal to or less than the height of the communications card 200. Additionally, as shown in the accompanying figures, the receptacles 220, 222 are located entirely in the front surface 242 of the modular jack 230, and the upper surface 234 of the modular jack 230 is a solid, planar surface that does not include any openings or cutouts.

The modular jack 230 is releasably attached to the housing 202 of the communications card 200 by a pair of guide rails 246, 248 that are located on the right and left sides 238, 240 of the jack, respectively. These guide rails 246, 248 have a dovetail shape and are received within corresponding slots (not shown) in the housing 202 of the communications card 200. The guide rails 246, 248 preferably have a friction or interference fit with the corresponding slots to securely attach the modular jack 230 to the housing 202 of the communications card 200. Because the modular jack 230 is securely attached to the housing 202 of the communications card 200, forces associated with inserting and removing connector plugs from the receptacles are primarily transmitted to the housing and not the printed circuit board 218. One skilled in the art will appreciate, however, that the modular jack does not have to be connected to the housing of the communications card and instead the modular jack may be connected to any suitable portion of the communications card. Additionally, the modular jack may be directly connected to any desired electronic device, such as a computer, without the use of a communications card. Further, any suitable structures may be used to connect the modular jack to the electronic device.

Figure 11:
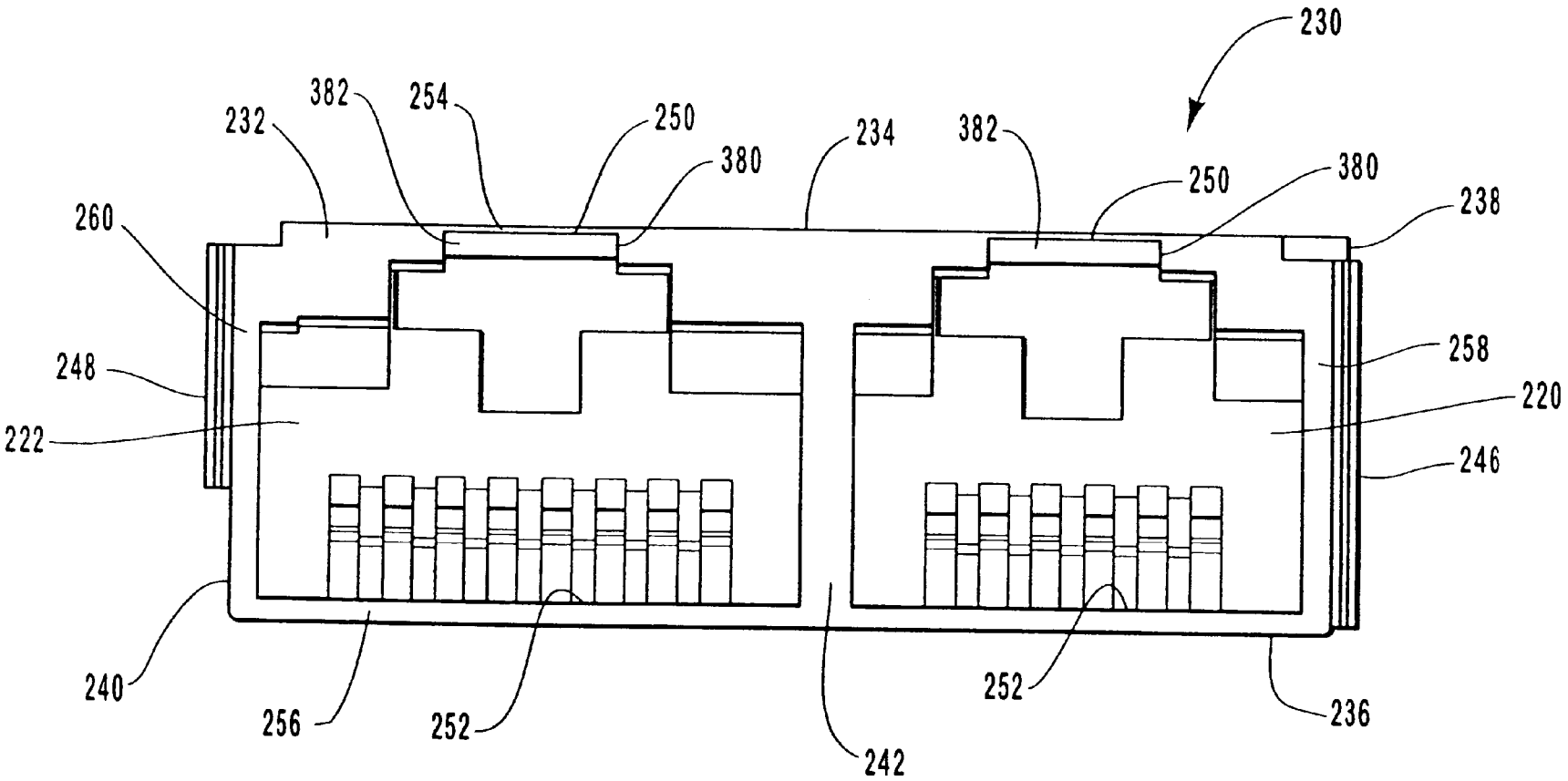
FIG. 11 is a front view of the modular jack shown in FIG. 10.

In a preferred embodiment, as best seen in FIG. 11, the main body portion 232 of the modular jack 230 has a height of about 10.5 mm measured from the upper surface 234 to the lower surface 236, and the receptacles 220, 222 have a height of about 10.1 mm measured from an uppermost surface 250 to the lower surface 252 of the receptacle. The upper wall 254 of the receptacles 220, 222 has a thickness of about 0.2 mm and the lower wall 256 of the receptacles also has a thickness of about 0.2 mm. The main body portion 232 of the modular jack 230 has a depth of about 10.8 mm measured from the front surface 242 to the rear surface 244, and the receptacles 220, 222 have a depth of about 9.8 mm measured from the front surface to the inner surface of the rear wall 262 of the receptacle. The right and left sides walls 258, 260 of the modular jack 230 have a thickness of about 1.0 mm, and the rear wall 262 of the receptacles 220, 222 also has a thickness of about 1.0 mm.

Figure 10:
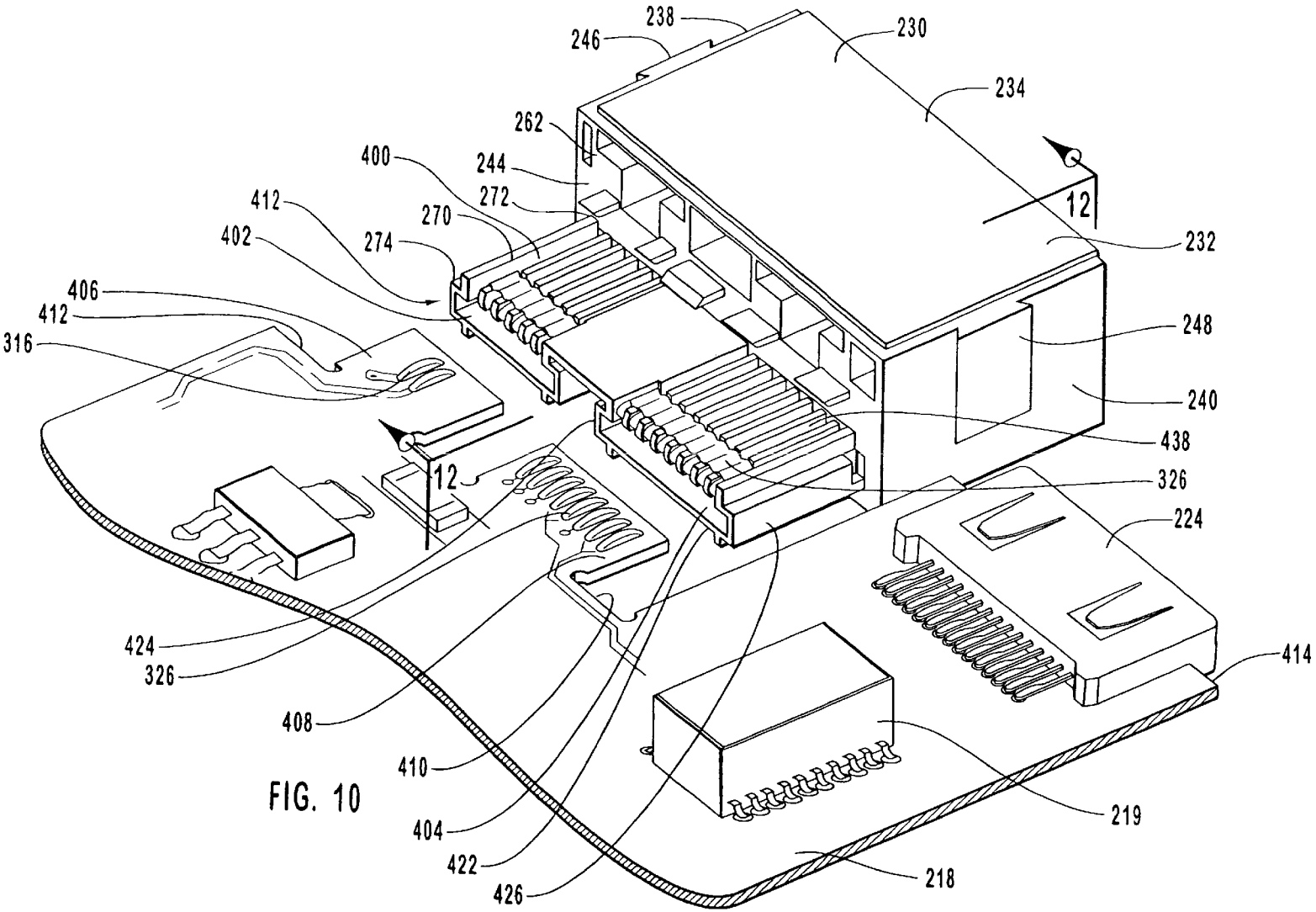
FIG. 10 is an exploded, perspective view of a portion of the communications card shown in FIG. 9, illustrating the modular jack detached from the printed circuit board, with a portion of the printed circuit board cut away.
Figure 12:
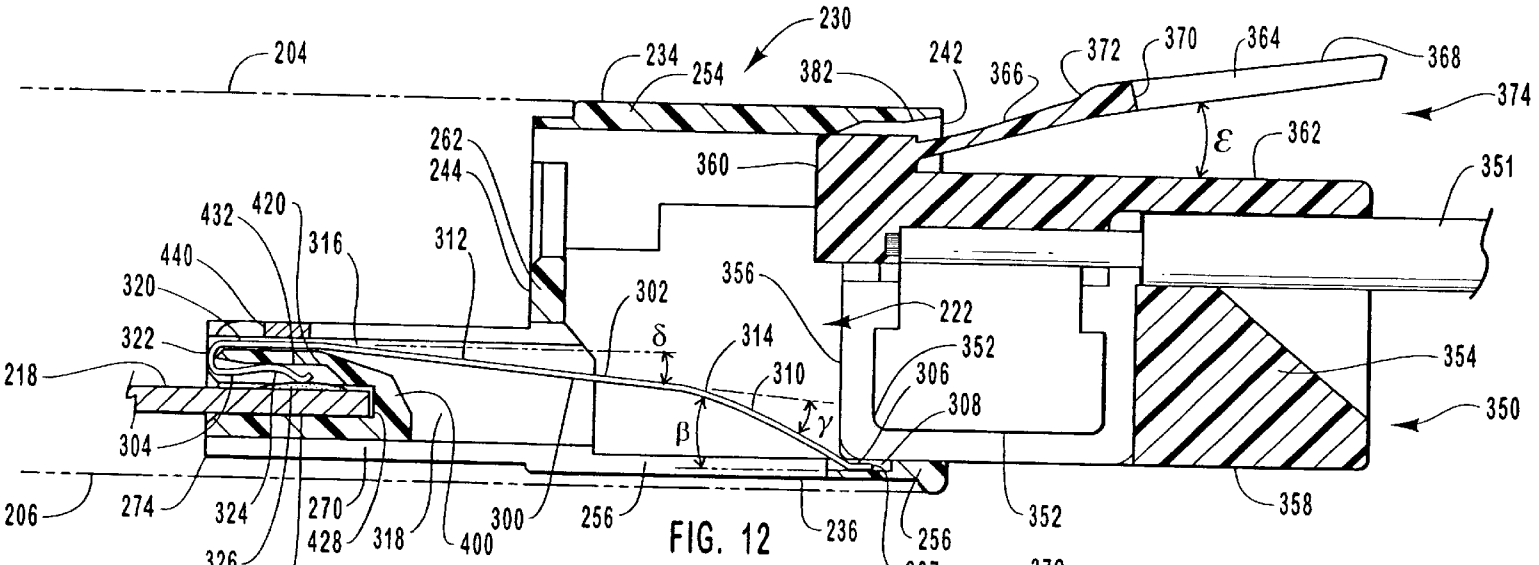
FIG. 12 is a cross-sectional side view of the modular jack shown in FIG. 11, illustrating the plug initially inserted into the opening of the receptacle, with the plug in the relaxed position.
Figure 13:
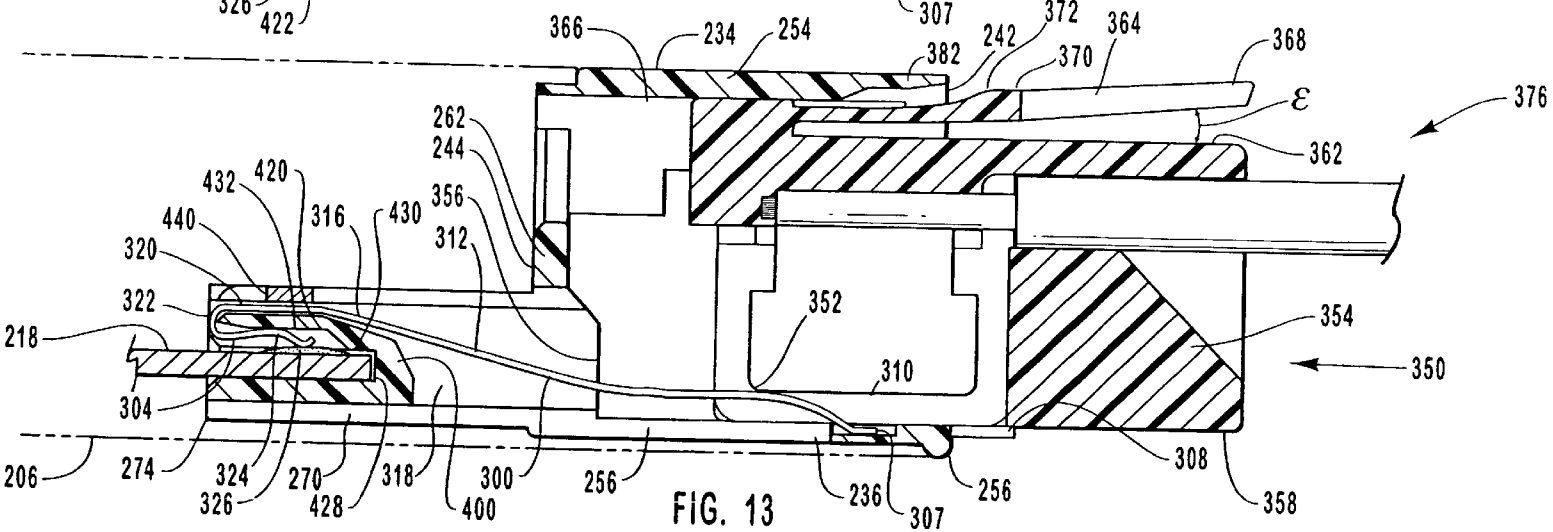
FIG. 13 is a cross-sectional side view of the modular jack shown in FIG. 11, illustrating the plug partially inserted into the opening of the receptacle, with the plug in the insertion position.

As best seen in FIGS. 10, 12 and 13, the modular jack 230 also includes a rearwardly extending connector 270 with a first end 272 attached to the modular jack 230 and an opposing second end 274. The rearwardly extending connector 270 has a length of about 8.7 mm and it is used to electrically connect the modular jack 230 to the printed circuit board 218. Those skilled in the art will readily appreciate, however, that the modular jack 230 can have a variety of different sizes and configurations depending, for example, upon the type of connectors, intended use of the communications card, size and shape of the communications card, and specific applications of the communications card.

One or more contact pins 300 are located within the receptacles 220, 222 of the modular jack 230. Typically, four or six contact pins are used in conjunction with an RJ-11 connector and eight contact pins are used in conjunction with an RJ-45 connector, but any suitable number of contact pins may be utilized. Advantageously, the contact pins 300 shown in connection with these preferred embodiments can be used in conjunction with both RJ-11 and/or RJ-45 connectors. Thus, the same contact pin design may be used with one or more types of RJ connectors, but at the contact pins may be manufactured in any of a wide variety of designs and configurations in order to be used with specific applications or connectors. Thus, while the contact pins 300 shown in the accompanying figures are representative of preferred embodiments, it will be appreciated that the contact pins may also have other suitable shapes and configurations.

Figure 14:
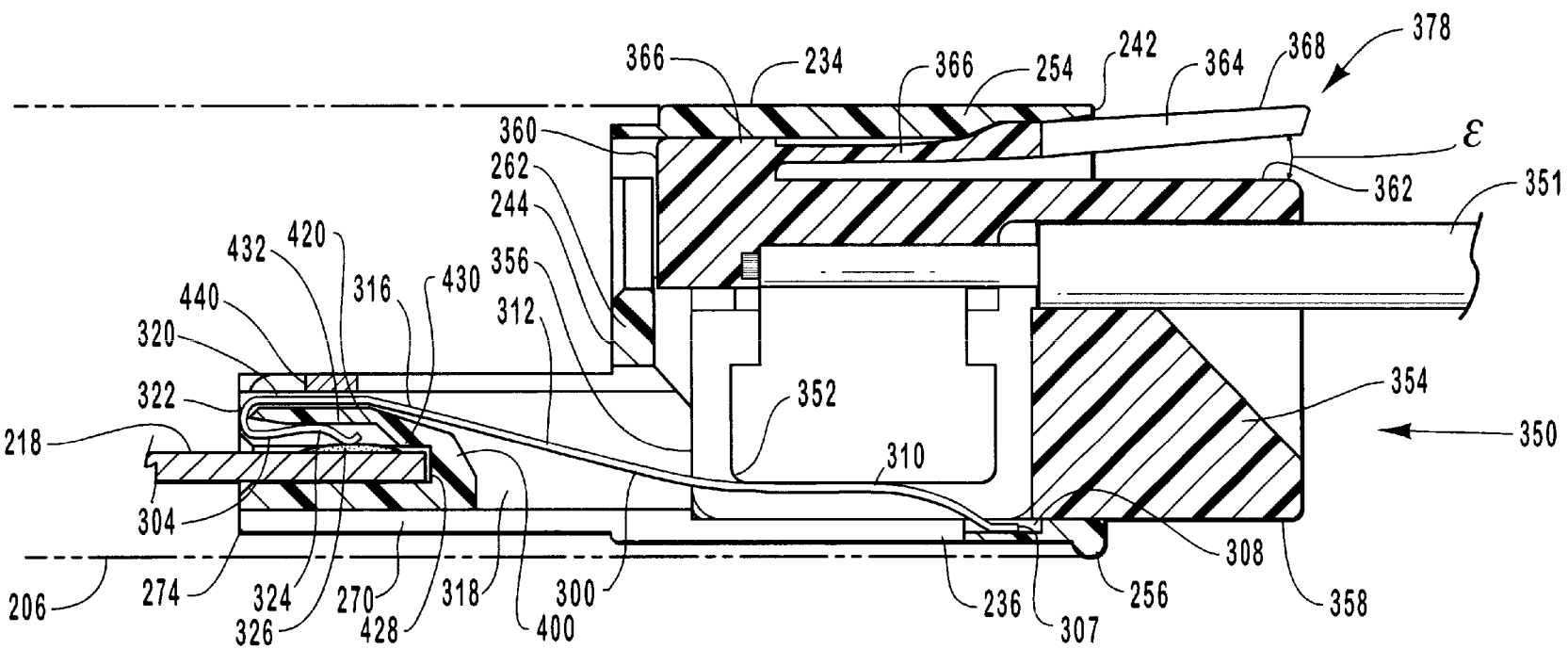
FIG. 14 is a cross-sectional side view of the modular jack shown in FIG. 11, illustrating the plug fully inserted into the receptacle of the modular jack, with the plug in the attached position.

As seen in FIGS. 12 to 14, exemplary contact pin 300 located in the receptacle 222 includes a plug engaging portion 302 and a connector portion 304. Briefly, the plug engaging portion 302 is flexible and elastically deforms or deflects as the plug 350 is inserted into the receptacle 222. The connector portion 304, on the other hand, is generally held in a generally fixed position and it is used to electrically connect the modular jack 230 to the printed circuit board 218 disposed within the housing 202 of the communications card 200. Additional details regarding preferred embodiments of the contact pins are provided in assignee's copending U.S. patent application Ser. No. 09/528,500 filed Mar. 20, 2000, entitled Contact Pin Design for a Modular Jack, which is hereby incorporated by reference it its entirety.

The plug engaging portion 302 of the contact pin 300 extends generally along a longitudinal axis from the front surface 242 of the receptacle 222 to the rear end 274 of the rearwardly extending connector 270 of the modular jack 230. The plug engaging portion 302 of the contact pin 300 includes a first section 306 positioned within a groove or slot 308 located in the lower wall 256 of the receptacle 222. The groove 308 is located proximate the front surface 242 of the receptacle 222, where the plug 350 is initially inserted into the receptacle. The first section 306 has a generally planar configuration to help hold this portion of the contact pin 300 within the groove 308. The first section 306 may also include a generally planar or slightly upwardly extending end 307, but the end should not protrude above the upper surface of the groove 308 or into the receptacle 222. Because the first section 306 of plug engaging portion 302 is located below the lower surface 252 of the receptacle 222, the plug 350 will not catch on or contact the end 307 or first section 306 of the contact pin 300 when the plug is inserted into or removed from the receptacle. Additionally, the groove 308 helps prevent lateral or side-to-side movement of the contact pin 300, which prevents the pin from contacting other pins and it keeps the pins separated by a desired distance.

The first section 306 of the plug engaging portion 302 may be either movable or held in a fixed position within the groove 308 depending, for example, upon the desired use of the connector. If the first section 306 is desired to be movable within the groove 308, it should have sufficient size and length to allow longitudinal movement within the groove, but the first section should not be displaced from the groove. On the other hand, if the first section 306 is secured in a fixed position within the groove 308, it should have sufficient size and length to be securely held in place. In either configuration, the first section 306 should have sufficient surface area, material strength and stress dispersion capabilities to prevent the contact pin from breaking or otherwise being damaged when the plug 350 is being inserted into the receptacle 222.

The contact pin 300 includes an upwardly angled section 310, which is the first portion of the contact pin to engage the plug 350 as it is inserted into the receptacle 222. The upwardly angled section 310 has a length of about 4 mm and it is connected to the first section 306 at an angle $\beta$ of between about 5° and about 60°. More preferably, the upwardly angled section 310 and the first section 306 are joined at an angle $\beta$ of between about 30° and about 45°, or less, in order to minimize the stress on the contact pin 300 as the plug 350 is inserted into the receptacle 222. One skilled in the art will appreciate that the angle and length of the upwardly angled section 310 may impact the deflection and stress on the contact pin 300, and that the upwardly angled section may have different lengths and angles depending upon the desired configuration of the pin.

The contact pin 300 also includes an elongated arm 312 connected to the upwardly angled section 310. In particular, a curved section 314 joins the upwardly angled section 310 and the elongated section 312 at an angle $\gamma$ between about 5° and 60°. More preferably, the curved section 314 joins the sections 310, 312 at about an angle $\gamma$ of between about 15° and about 30° to minimize the stress in the contact pin and to provide secure engagement of the contact pin 300 with corresponding contacts in the plug 350. The elongated arm 312 is preferably angled slightly upwardly at an angle $\delta$ of between about 5° and 15°, but the angle could be greater or smaller. It will be appreciated that the plug engaging portion 302 of the contact pin 300 may also be generally straight and not include the curved section 314, or the contact pin may include one or more curved sections. In this preferred embodiment, the plug engaging portion 302 does not include any portions that have an angle larger than about 90° in order to minimize stress and increase durability of the pin 300. More preferably, the plug engaging portion 302 does not include any portions that are angled more than 60° to further increase reliability and decrease stress.

The elongated arm 312 preferably has a length of about 10.0 mm, which is generally equal to or greater in length than the depth of the receptacle 222. Because the arm 312 has an elongated length, it permits a relatively large deflection of the pin 300 as the plug 350 is inserted into the receptacle 222. The distal end 316 of the elongated arm is disposed within a slot 318 located in the rearwardly extending connector 270. The slot 318 allows the elongated arm 312 to move vertically while preventing lateral or side-to-side movement of the contact pin 300. The slot 318 is aligned with the groove 308 located proximate the front surface 242 of the receptacle to position the contact pin 300 in the desired location.

The elongated arm 312 is attached to the connector portion 304 and the connector portion is used to electrically connect the contact pin 300 to the printed circuit board 218. As discussed in greater detail below, the connector portion 304 includes a flat first section 320, a curved section 322 and an engaging portion 324 that is sized and configured to electrically engage corresponding contacts 326 on the printed circuit board 218. These contacts 326 on the edge of the printed circuit board 218 may comprise any suitable number of traces or leads. A preferred embodiment of connecting the modular jack to the printed circuit board is described in assignee's copending U.S. patent application Ser. No. 09/528,501, filed Mar. 20, 2000, entitled Card Edge Connector for a Modular Jack, which is hereby incorporated by reference it its entirety.

As best seen in FIG. 10, the modular jack 230 includes the rearwardly extending connector 270 that is integrally attached to the rear wall 262 of the main body portion 232 of the modular jack. The rearwardly extending connector 270 includes a body 400 with a first socket 402 and a second socket 404 that are sized and configured to receive corresponding portions 406, 408 of the printed circuit board 218. The portions 406, 408 are located proximate an inner edge 410 of the printed circuit board 218 and preferably project outwardly from the inner edge of the printed circuit board. Desirably, the inner edge 410 forms part of a relief or cutout 412 of the printed circuit board 218 that is sized and configured to receive the modular jack 230. More desirably, the relief 412 is sized and configured such that when the modular jack 230 is electrically connected to the printed circuit board 218, the front surface 242 of the modular jack is generally aligned with the front surface of the connector 224 or a front edge 414 of the printed circuit board. It will be understood that the portions 406, 408 of the printed circuit board 218 may also be aligned with the inner edge 410 of the printed circuit board 218 or be recessed into the printed circuit board.

Disposed on the upper surface of the printed circuit board 218 are contacts 326 that are electrically connected to desired circuitry or components 219 on the printed circuit board. These contacts 326 may comprise a portion of an electrical lead or trace, and the contacts preferably have a length less than the length of the portions 406, 408 of the printed circuit board 218. The number of contacts 326 on the printed circuit board 218 desirably corresponds to the number of contact pins 300 in the modular jack 230, but it is contemplated that the number of contacts may not correspond to the number of contact pins. Additionally, although not shown in the accompanying figures, one skilled in the art will recognize that the lower surface of the printed circuit board 218 may also include electrical contacts that are electrically connected to the modular jack 230.

The sockets 402, 404 in the body 400 of the rearwardly extending connector 270 include a top wall 420, a bottom wall 422, a right sidewall 424, a left sidewall 426 and a rear wall 428. As best seen in FIGS. 12 and 13, the top wall 420 and the bottom wall 422 are separated by two different heights such that the rear end 430 of the receptacles 402, 404 have a height that is slightly greater than the thickness of the printed circuit board 218. The forward end 432 of the receptacles 402, 404, however, have a larger height such that the printed circuit board 218 and the engaging portion 324 of the contact pin 300 can be disposed between the top wall 420 and the bottom wall 422 of the receptacle.

The upper surface 434 and lower surface 436 of the top wall 420 of the receptacles 402, 404 preferably include grooves that are sized and configured to receive the connector portion 304 of the contact pins 300. In greater detail, the upper surface 434 of the top wall 420 includes grooves 438 that contain the first flat sections 320 of the contact pin 300 and these grooves are aligned with the slots 318 that extend towards the rear wall 262 of the modular plug 230. A cross member 440 holds the first flat sections 320 of the contact pins 300 in a fixed position relative to the rearwardly extending connector 270. Thus, the connector portion 304 of the contact pins 300 generally does not bend or deflect as the plug 350 is inserted or removed from the receptacle 222. Instead, the plug engaging portion 302 primarily bends or deflects as the plug 350 is inserted or removed from the receptacle 222.

The lower surface 436 of the top wall 420 may also include grooves 442 that are generally aligned with the grooves 438 in the upper surface 434 of the top wall 420. These grooves 442 in the lower surface 436 receive the engaging portions 324 of the contact pins 300 when the rearwardly extending connector 270 is attached to the printed circuit board 218. One skilled in the art will appreciate that the grooves 438, 442 in the upper and lower surfaces 424, 426 of the top wall 420 are not required and that other suitable types of alignment devices, such as walls or partitions, may also be used to position the contact pins 300 in the desired locations.

As shown in FIGS. 12 to 14, the first flat section 320 of the contact pin 300 is preferably located generally parallel to the lower surface 252 of the receptacle 320 and the curved section 322 is curved about the rear end 274 of the rearwardly extending connector 270. The engaging portion 324 of the contact pin 300 extends into the socket 404 and it resiliently engages the contact 326 on the upper surface of the printed circuit board 218. This allows electrical communication between the printed circuit board 218 and the contact pin 300 to be established. Advantageously, because the engaging portion 324 of the contact pin 300 is biased to engage the contact 326, this results in positive electrical contact between the contact and the contact pins. If the modular jack 230 is disconnected from the printed circuit board 300, the portions 406, 408 of the printed circuit board 218 are removed from the sockets 402, 404 and the engaging portion 324 of the contact pin 300 resiliently springs back to its original position. Thus, the modular jack 230 and the printed circuit board 218 can be repeatedly attached and disconnected as desired.

As discussed above, numerous specific dimensions and configurations are provided in connection with preferred embodiments of the modular jack 230. It will be understood, however, that these dimensions and configurations may be changed or modified for specific applications and designs. Thus, for example, the modular jack 230 could also have a square, circular, curvilinear or other compound or complex shapes without deviating from the scope or spirit of the invention.

The modular jack 230 is desirably integrally molded, for example, by injection molding, thermal forming, vacuum forming of a pre-formed sheet of plastic, or the like. Alternatively, components such as the main body portion 232 and rearwardly extending connector 270 can be separately molded, stamped, machined, etc., and then bonded together. The bonding process can involve thermal bonding, solvent bonding, ultrasonic welding or other techniques known in the art. The modular jack 230 is desirably constructed from plastics such nylon, but other suitable plastics, synthetics, and other metallic or nonmetallic materials with suitable properties and characteristics may also be used.

The physical and electrical connection of the plug 350 to the receptacle 222 will now be described in detail. As shown in FIGS. 12 to 14, the plug 350 includes a contact pin block 354 that houses a plurality of contacts 352. The contacts 352 are recessed within tracks that are accessible from front and lower surfaces 356, 358 of the contact pin block 354. The contact pin block 354 includes a forwardly extending surface 360 that is flanked by a pair of notches that define front abutment surfaces (not shown), which are located generally perpendicular to an upper surface 362 of the contact pin block. A biased clip 364 extends upwardly from the upper surface 362 of the contact pin block 354 and it includes a broad base 366 and a narrow tab 368. An abrupt transition between the base 366 and the tab 368 forms retention edges 370 on both sides of the tab. The upper surface of the biased clip 364 may also include an angled or inclined surface 372.

As seen in FIG. 12, the biased clip 364 is in a relaxed position 374 and no external forces are being applied to the biased clip. Thus, the biased clip 364 freely extends at an angle $\epsilon$ relative to the upper surface 362 of the contact pin block 354, and there is a relatively large gap or space between the biased clip and the upper surface of the contact pin block. Because the biased clip 364 is flexible and elastic, it resiliently returns to this relaxed position 374 whenever no external forces are being applied to the clip.

As shown in FIG. 13, in an insertion position 376, the plug 350 is being inserted into the receptacle 222 and the biased clip 364 is deflected downwardly such that it contacts or there is a very small angle $\epsilon$ and little or no gap between the biased clip and the upper surface 362 of the contact pin block 354. The biased clip 364 may be deflected either by the user applying a downward force to the biased clip or, as the plug 350 is inserted into the receptacle 222, the base 366 of the biased clip engages the notches 380 located proximate the upper wall 250 of the receptacle and this pushes the clip downwardly.

As shown in FIG. 14, in an attached position 378, the plug 350 is inserted into the receptacle 222 until the forwardly extending surface 360, the front abutment surfaces or the front surface 356 contacts or is positioned proximate the rear wall 262 of the receptacle 222. The biased clip 364 then springs upwardly when the plug 350 is fully inserted into the receptacle 222 because the base 366 of the biased clip 364 no longer engages the notches 380. In this attached position 378, the retention edges 370 of the biased clip 364 contact the rear surfaces of the notches 380 located in the front face 242 of the receptacle 222 and the tab 368 extends through the opening 382 between notches. Additionally, the inclined surface 372 of the biased clip 364 nests within a corresponding notch 382 in the upper surface 254 of the receptacle. Because the upper wall 254 of the receptacle 222 has a very small thickness, especially proximate the opening 382, it may be desirable to strengthen this portion of the receptacle. For example, a support plate constructed of a relatively high strength material, such as metal, may be insert molded into the upper wall 254 or the upper surface 204 of the housing 202 may be configured to extend over the upper wall of the receptacle 222.

Significantly, the biased clip 364 remains partially compressed in the attached position 378. Thus, the biased clip 364 continually forces the contacts 352 of the plug 350 into engagement with the engaging portion 302 of the contact wire 300, and this results in positive electrical contact between the plug and the modular jack. In greater detail, in the attached position 378, the biased clip 364 is biased against the notch 382 in the upper wall 254 of the receptacle, and the clip is positioned at an angle $\epsilon$ that is between that relaxed position 374 and the insertion position 376. Additionally, in the attached position 378, the biased clip 364 and the upper surface 362 of the contact pin block 354 are separated by a gap that is less than the gap in the relaxed position 374 and larger than the gap in the insertion position 376.

The biased clip 364 maintains this interconnection of the plug 350 and receptacle 222 until the user depresses the biased clip 364 towards the contact pin block 354 to disengage the retention edges 370 of the biased clip from the rear surfaces of the notches 380. The user then can slide the plug 350 out of the receptacle 222 to disconnect the plug from the receptacle. Thus, when the communications card is not in use, the user can disconnect the plug 350 from the receptacle 222 by depressing the biased clip 364 towards the contact pin block 354 and pulling the plug out of the receptacle.

In a preferred embodiment of the modular jack 230, the retention edges 370 on the biased clip 364 and the rear surfaces of the notches 380 form part of a latching area 384. Advantageously, these edges and surfaces are sized and angled such that when sufficient force is applied to the plug 350, the plug 350 will be released from the receptacle without depressing the biased clip. Thus, if sufficient force is applied to the plug 350 or the cable 351 attached to the plug, the latching area 384 allows the plug to be released from the receptacle 222 without breaking the biased clip 364 or pulling the cable out of the plug. Therefore, if a large force is accidentally applied to the plug 350 or cable 351, such as the user stepping on the cable or the computer being unexpectedly moved, the latching area 384 allows the plug to be released from the receptacle 222 without damaging the plug or the receptacle.

In greater detail, the rear surfaces of the notches 380 are angled slightly forwardly and/or the notches have a smaller height to allow the plug 350 to be removed from the receptacle 222 without depressing the biased clip 364. The retention edges 370 on the biased clip 364 may also be slightly angled and/or have a smaller height to allow the plug 350 to be removed from the receptacle 222 without depressing the biased clip. Additionally, because the biased clip 364 remains partially compressed in the attached position 378 and the tab 368 of the biased clip nests within the notch 382 in the upper surface of the receptacle 222, and the biased clip is not contained within an opening or cutout in the top surface of the communication card, the plug can be removed from the receptacle without depressing the biased clip. One skilled in the art will appreciate that the latching area 384 may have different sizes and configurations depending upon the amount of force required to remove the plug from the receptacle.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A modular jack that allows a RJ series connector plug to be connected to a communications card that conforms to the PCMCIA requirements for a Type III PC card, the modular jack comprising:

a main body portion including a first outer surface, an opposing second outer surface, and a front surface, the first outer surface and the second outer surface being separated by a distance of 10.5 mm or less; and a receptacle located in the front surface of the modular jack that is sized and configured to receive the RJ series connector plug along a generally longitudinal axis such that no portion of the plug extends through either the first outer surface or the second outer surface of the main body portion of the modular jack when the plug is inserted into the receptacle;

wherein there is no cutout in the first outer surface or the second outer surface that is configured to allow a biased clip of the plug to protrude through the outer surfaces.

2. The modular jack as in claim 1, wherein the first outer surface and the second outer surface of the main body portion comprise generally solid, planar surfaces that prevent any portion of the RJ series connector plug from extending through the first or second outer surfaces.

3. The modular jack as in claim 1, wherein the receptacle includes an upper inner surface and a lower inner surface that are separated by a distance that is generally equal to or less than about 10.1 mm.

4. The modular jack as in claim 3, further comprising one or more grooves in the lower inner surface of the receptacle that are located proximate the front surface of the main body portion, each of the one or more grooves being sized and configured to receive an end of a contact pin.

5. The modular jack as in claim 4, further comprising one or more slots in a rear wall of the main body portion, the one or more slots being generally aligned with the one or more grooves.

6. The modular jack as in claim 1, further comprising a latching area that is sized and configured to securely hold the RJ series connector plug within the receptacle, the latching area also being sized and configured to allow the RJ series connector plug to be removed from the receptacle without the user depressing a biased clip of the connector plug if sufficient force is applied to a body of the connector plug.

7. The modular jack as in claim 6, wherein the latching area includes a first pair of notches and a second pair of notches in the front wall of the receptacle, wherein at least one of the pairs of notches includes one or more angled inner surfaces to allow the RJ series connector plug to be removed from the receptacle without depressing the biased clip.

8. The modular jack as in claim 6, wherein the latching area includes a first pair of notches and a second pair of notches in the front wall of the receptacle, wherein at least one of the pairs of notches includes a height to allow the RJ series connector to be removed from the receptacle without depressing the biased clip.

9. The modular jack as in claim 1, further comprising a connector attached to a rear surface of the main body portion, the connector including a socket being sized and configured to receive a portion of a printed circuit board disposed within the communications card to allow electrical communication to be established between the printed circuit board and the modular jack.

10. The modular jack as in claim 9, further comprising at least one contact pin including a plug engaging portion and a printed circuit board engaging portion, the plug engaging portion extending into the receptacle and the printed circuit board engaging portion extending into the socket.

11. The modular jack as in claim 1, wherein the receptacle is sized and configured to either an RJ-11 or an RJ-45 connector plug.

12. A communications card conforming to the PCMCIA guidelines for a Type III PC card, the communications card comprising:

a housing including a top surface, a bottom surface and a front surface;

a circuit board disposed within the housing, the circuit board including one or more electrical contacts;

a modular jack electrically connected to the circuit board, the modular jack including a first outer surface, a second outer surface and a front surface, the first outer surface and the second outer surface being separated by a distance that is generally equal to or less than about 10.5 mm; and a receptacle disposed in the front surface of the modular jack, the receptacle being sized and configured to receive a RJ series connector plug along a generally longitudinal axis such that no portion of the plug extends through either the first outer surface or the second outer surface of the modular jack when the plug is inserted into the receptacle;

wherein there is no cutout in the first outer surface or the second outer surface that is configured to allow a biased clip of the plug to protrude through the outer surfaces.

13. The communications card as in claim 12, further comprising a socket attached to the modular jack, the socket being sized and configured to receive a portion of the circuit board disposed within the communications card to allow electrical communication to be established between the circuit board and the modular jack.

14. The communications card as in claim 12, wherein the first outer surface and the second outer surface of the modular jack comprise generally solid, planar surfaces that prevent any portion of the RJ series connector plug from extending through the first outer surface or the second outer surface.

15. The communications card as in claim 12, wherein the first outer surface of the modular jack is a generally solid, planar surface that is generally aligned with the top surface of the housing and the second outer surface of the modular jack is a generally solid, planar surface that is generally aligned with the bottom surface of the housing.

16. The communications card as in claim 12, wherein the receptacle includes an upper inner surface and a lower inner surface that are separated by a distance that is generally equal to or less than about 10.1 mm.

17. The communications card as in claim 12, further comprising a latching area for the receptacle, the latching area being sized and configured to securely hold the RJ series connector plug within the receptacle, the latching area also being sized and configured to allow the RJ series connector plug to be removed from the receptacle without the user depressing a biased clip if sufficient force is applied to a body of the connector plug.

18. An electrical connector comprising:

a communications card including a housing with an upper surface and two side walls, the upper surface and the side walls forming a cavity;

a circuit board disposed within the cavity of the housing;

one or more electrical contacts disposed on the circuit board;

a modular jack attached to the housing of the communications card, the modular jack including a first outer surface, a second outer surface and a front surface, the first outer surface and the second outer surface being separated by a distance of about 10.5 mm or less, the modular jack being electrically connected to the one or more electrical contacts disposed on the circuit board; and a receptacle in the modular jack that is sized and configured to receive a RJ series connector plug along a generally longitudinal axis such that no portion of the plug extends through either the first outer surface or the second outer surface of the modular jack when the plug is inserted into the receptable;

wherein the first outer surface and the second outer surface do not include a cutout that is configured to allow a biased clip of the plug to protrude through the outer surfaces.

19. The electrical connector as in claim 18, further comprising a socket attached to the modular jack, the socket being sized and configured to receive a portion of the printed circuit board containing the one or more electrical contacts.

20. The electrical connector as in claim 18, further comprising at least one contact pin including a plug engaging portion and a printed circuit board engaging portion, the plug engaging portion extending into the receptacle and the printed circuit board engaging portion extending into the socket.

21. The electrical connector as in claim 18, wherein the RJ series plug includes a body and a biased clip, wherein the biased clip remains partially depressed when the plug is received within the receptacle.

22. The electrical connector as in claim 18, further comprising a RJ series plug including a body and a biased clip, the biased clip being in a relaxed position when the plug is not inserted into the receptacle and the biased clip extending at a first angle relative to an upper surface of the body of the plug, the biased clip being in an insertion position when the plug is inserted into the receptacle and the biased clip extending at a second angle relative to the upper surface of the body of the plug, the second angle being smaller than the first angle, and the biased clip being in an attached position when the plug is held within the receptacle and the biased clip extending at a third angle relative to the upper surface of the body of the plug, the third angle being between that of the first angle and the second angle.

23. The electrical connector as in claim 18, wherein the receptacle is sized and configured to receive multiple types of the RJ series connector plug; and wherein no portion of the multiple types of RJ series plugs extend through either the first outer surface or the second outer surface of the main body portion of the modular jack.

24. A modular jack for connecting an electronic device or communication system to a communications card conforming to Type III PCMCIA standards, the modular jack comprising:

a main body portion including a top surface, a bottom surface, a front surface and a rear surface, the main body portion having a height measured from the first outer surface to the second outer surface that is generally equal to or less than about 10.5 mm;

a receptacle being entirely disposed within the front surface of the main body portion, the receptacle being sized and configured to receive a RJ series connector plug along a generally horizontal axis such that no portion of the plug extends through either the top surface or the bottom surface of the main body portion when the plug is inserted into the receptacle, the first outer surface and the second outer surface not including any cutouts that are sized and configured to allow a biased clip of the plug to protrude through the outer surfaces;

a latching area that is sized and configured to retain the RJ series connector plug within the receptacle, the latching area holding a biased clip of the plug in a partially depressed position when the plug is retained within the receptacle;

a rearwardly extending connector attached to the rear surface of the modular jack, the connector including a socket sized and configured to removably receive a portion of a circuit board; and a plurality of contact pins, each of the plurality of contact pins including a plug engaging portion that is at least partially disposed within the receptacle and a circuit board engaging portion that is at least partially disposed within the socket, the plurality of contact pins allowing electrical communication to be established between the receptacle and the circuit board.

25. The modular jack as in claim 24, wherein the latching area is also sized and configured to allow the RJ series connector plug to be removed from the receptacle without the user depressing a biased clip of the connector plug if a predetermined force is applied to a body of the connector plug.

26. A communications card conforming to the PCMCIA guidelines for a Type III PC card, the communications card comprising:

a housing including an extended upper surface, an extended lower surface and a front surface, the upper surface and the lower surface being separated by a distance of 10.5 mm or less;

electronic circuitry disposed within the housing; and a receptacle disposed in the front surface of the housing, the receptacle being sized and configured to receive a RJ series connector plug along a generally longitudinal axis such that no portion of the plug extends through either the upper surface or the lower surface of the housing when the plug is received within the receptacle, the upper surface and the lower surface including no cutouts that are sized and configured to allow a biased clip of the plug to protrude through the upper or lower surface.

27. The communications card as in claim 26, wherein the upper surface and the lower surface of the housing comprise generally solid, planar surfaces that prevent any portion of the RJ series connector plug from extending through the upper surface or the lower surface.

28. The communications card as in claim 26, wherein the receptacle includes an upper inner surface and a lower inner surface that are separated by a distance that is generally equal to or less than about 10.1 mm.

29. The communications card as in claim 26, further comprising a latching area for the receptacle, the latching area being sized and configured to securely hold the RJ series connector plug within the receptacle.

30. The communications card as in claim 29, wherein the latching area includes a first pair of notches and a second pair of notches in the front wall of the receptacle, wherein at least one of the pairs of notches includes one or more angled inner surfaces to allow the RJ series connector plug to be removed from the receptacle without depressing the biased clip.

31. The communications card as in claim 29, wherein the latching area includes a first pair of notches and a second pair of notches in the front wall of the receptacle, wherein at least one of the pairs of notches includes a height to allow the RJ series connector to be removed from the receptacle without depressing the biased clip.

32. The communications card as in claim 26, wherein a biased clip of the connector plug remains in a partially depressed position when the RJ series connector plug is received within the receptacle.

33. The communications card as in claim 26, wherein a biased clip of the RJ series connector plug is in a relaxed position when the plug is not inserted into the receptacle and the biased clip extends at a first angle relative to an upper surface of the plug; wherein the biased clip is in an insertion position when the plug is inserted into the receptacle and the biased clip extends at a second angle relative to the upper surface of the body of the plug, the second angle being smaller than the first angle; and wherein the biased clip is in an attached position when the plug is received within the receptacle and the biased clip extends at a third angle relative to the upper surface of the body of the plug, the third angle being between that of the first angle and the second angle.

* * * * *

UNITED STATES PATENT AND TRADEMARK OFFICE

CERTIFICATE OF CORRECTION

PATENT NO. : 6,338,656 B1
DATED : January 15, 2002
INVENTOR(S) : David Oliphant et al.

It is certified that error appears in the above-identified patent and that said Letters Patent is hereby corrected as shown below:

Column 10,
Line 59, after “reference” change “it” to -- in --.

Column 14,
Line 8, after “such” insert -- as --.
Line 49, after “contacts” change “or is” to -- are --.

Signed and Sealed this

Eleventh Day of October, 2005

JON W. DUDAS
*Director of the United States Patent and Trademark Office*